US006030518A

United States Patent [19]

Dawless et al.

[11] Patent Number: 6,030,518

[45] Date of Patent: Feb. 29, 2000

[54] REDUCED TEMPERATURE ALUMINUM PRODUCTION IN AN ELECTROLYTIC CELL HAVING AN INERT ANODE

[75] Inventors: Robert K. Dawless, Monroeville; Siba P. Ray, Murrysville; Robert B. Hosler, Sarver; Robert L. Kozarek, Apollo; Alfred F. LaCamera, Trafford, all of Pa.

[73] Assignee: Aluminum Company of America, Pittsburgh, Pa.

[21] Appl. No.: 08/926,530

[22] Filed: Sep. 10, 1997

Related U.S. Application Data

[63] Continuation-in-part of application No. 08/883,060, Jun. 26, 1997, Pat. No. 5,794,112, and a continuation-in-part of application No. 08/883,061, Jun. 26, 1997, Pat. No. 5,865,980.

[51] Int. Cl.[7] ..... C25C 3/06; C25C 3/08; C25C 3/18

[52] U.S. Cl. ..... 205/387; 205/394; 205/395; 204/243.1; 204/244; 204/291; 204/292

[58] Field of Search ..... 205/372, 387, 205/394, 395; 204/243–247, 291, 292

[56] References Cited

U.S. PATENT DOCUMENTS

| | | | |
|---|---|---|---|
| 4,620,905 | 11/1986 | Tarcy et al. | 205/387 |
| 5,019,225 | 5/1991 | Darracq et al. | 205/350 |
| 5,279,715 | 1/1994 | LaCamera et al. | 205/373 |
| 5,284,562 | 2/1994 | Beck et al. | 204/244 X |
| 5,378,325 | 1/1995 | Dastolfo, Jr. et al. | 205/394 |
| 5,865,980 | 2/1999 | Ray et al. | 205/387 X |

FOREIGN PATENT DOCUMENTS

| | | | |
|---|---|---|---|
| 2446314 | 4/1975 | Germany | 205/387 |

*Primary Examiner*—Donald R. Valentine
*Attorney, Agent, or Firm*—Glenn E. Klepac

[57] ABSTRACT

Aluminum is produced by electrolytic reduction of alumina in a cell having a cathode, an inert anode and a molten salt bath containing metal fluorides and alumina. The inert anode preferably contains copper, silver and oxides of iron and nickel. Reducing the molten salt bath temperature to about 900–950° C. lowers corrosion on the inert anode constituents.

20 Claims, 2 Drawing Sheets

REDUCED TEMPERATURE ALUMINUM PRODUCTION IN AN ELECTROLYTIC CELL HAVING AN INERT ANODE

PENDING RELATED APPLICATIONS

This application is a continuation-in-part of U.S. Ser. No. 08/883,060 filed Jun. 26, 1997 and entitled "Controlled Atmosphere for Fabrication of Cermet Electrodes" (now U.S. Pat. No. 5,794,112 issued Aug. 11, 1998) and of U.S. Ser. No. 08/883,061 filed Jun. 26, 1997 and entitled "Electrolysis With an Inert Electrode Containing a Ferrite, Copper and Silver" (now U.S. Pat. No. 5,865,980 issued Feb. 2, 1999).

The Government has rights in this invention pursuant to Contract No. DE-FC07-89 ID 12848 awarded by the Department of Energy.

FIELD OF THE INVENTION

The present invention relates to the electrolytic production of aluminum in a cell having a cathode, an inert anode and a molten salt bath containing metal fluorides and alumina.

BACKGROUND OF THE INVENTION

The cost of aluminum production can be significantly reduced by substituting inert anodes for the carbon anodes that are used in most commercial electrolytic cells today. The inert anodes are not consumed during aluminum production so that they are dimensionally stable. The use of a dimensionally stable inert anode together with a wettable cathode also allows more efficient cell designs, lower current densities and a shorter anode-cathode distance, with resulting energy savings.

The inert anode material must satisfy several demanding conditions. For example, the material must not react with the molten salt electrolyte or dissolve in it. The material must not react with oxygen or corrode in an oxygen-containing atmosphere at the cell operating temperature. The material must be relatively inexpensive and have good mechanical strength. It must have electrical conductivity greater than about 120 $ohm^{-1}$ $cm^{-1}$ at the cell operating temperature. In addition, aluminum produced in a cell having inert anodes should not be significantly contaminated by constituents of the inert anode material.

Aluminum smelting cells having inert anodes must be operated at sufficiently low temperatures that the molten salt bath is not volatilized. The operating temperature must be high enough that the electrolyte does not solidify and that alumina solubility in the electrolyte is sufficient to operate the cell efficiently. In addition, low cell operating temperatures pose a risk of developing high anode resistance.

A principal objective of our invention is to provide a process for producing aluminum in an electrolytic cell having an inert anode and a molten salt bath, wherein the molten salt bath temperature is controlled to avoid attack upon the inert anode.

A related objective of our invention is to provide a process for electrolytic production of aluminum in a cell having an inert anode and a molten salt bath, wherein alumina is soluble in the molten salt bath and high anode resistance is avoided.

Additional objectives and advantages of our invention will become apparent from the following detailed description.

SUMMARY OF THE INVENTION

The present invention relates to production of aluminum by electrolytic reduction of alumina dissolved in a molten salt bath. An electric current is passed between an inert anode and a cathode through the salt bath, thereby producing aluminum at the cathode and oxygen at the anode. The inert anode contains at least one metal oxide and copper, preferably the oxides of at least two different metals and a mixture or alloy of copper and silver.

The cermet materials in anodes we use are deemed inert because, unlike carbon, they do not react with oxygen generated by electrolysis of alumina. The cermet materials also have relatively low solubility in the electrolyte. However, inert electrodes are subject to corrosion through several different mechanisms. Aluminum droplets floating or suspended in the molten salt bath may rapidly attack all components of the anodes. This problem is more likely to occur at temperatures below 900° C. than at higher temperatures because lower operating temperatures are generally associated with higher electrolyte densities that can cause aluminum droplets to float. Secondly, aluminum and sodium dissolved in the molten salt bath may also attack the ceramic or dissolve the metallic components of the anode. The solubility of aluminum and sodium in cryolite drops rapidly from 960° C. to 910° C., probably by about a factor of five. Further reduction in temperature below 910° C. will reduce the solubility even more, but the benefit is small compared with other mechanisms such as electrochemical corrosion of the anode metal phase.

Our electrolytic cell operates at a temperature in the range of about 900°–950° C., preferably about 900°–940° C., more preferably about 900°–930° C. and most preferably about 900°–920° C. An optimum range is about 905°920° C. An electric current is passed between the inert anode and a cathode through a molten salt bath comprising an electrolyte and alumina. In a preferred cell, the electrolyte comprises aluminum fluoride and sodium fluoride, and the electrolyte may also contain calcium fluoride, magnesium fluoride and/or lithium fluoride. The weight ratio of sodium fluoride to aluminum fluoride is preferably about 0.7 to 1.1. At an operating temperature of 920° C., the bath ratio is preferably about 0.8 to 1.0 and more preferably about 0.96.

A particularly preferred cell comprises a plurality of generally vertical inert anodes interleaved with generally vertical cathodes. The inert anodes preferably have an active surface area about 0.5 to 1.3 times the surface area of the cathodes.

Reducing the cell bath temperature down to the 900°–950° C. range reduces corrosion of the inert anode. Lower temperatures reduce solubility in the bath of ceramic inert anode constituents. In addition, lower temperatures minimize the solubility of aluminum and other cathodically produced metal species such as sodium and lithium which have a corrosive effect upon both the anode metal phase and the anode ceramic constituents.

Inert anodes usefull in practicing our invention are made by reacting a reaction mixture with a gaseous atmosphere at an elevated temperature. The reaction mixture comprises particles of copper and oxides of at least two different metals. The copper may be mixed or alloyed with silver. The oxides are preferably iron oxide and at least one other metal oxide which may be nickel, tin, zinc, yttrium or zirconium oxide. Nickel oxide is preferred. Mixtures and alloys of copper and silver containing up to about 30 wt. % silver are preferred. The silver content is preferably about 2–30 wt. %, more preferably about 4–20 wt. %, and optimally about 5–10 wt. %, remainder copper. The reaction mixture preferably contains about 50–90 parts by weight of the metal oxides and about 10–50 parts by weight of the copper and silver.

The alloy or mixture of copper and silver preferably comprises particles having an interior portion containing more copper than silver, and an exterior portion containing more silver than copper. More preferably, the interior portion contains at least about 70 wt. % copper and less than about 30 wt. % silver, while the exterior portion contains at least about 50 wt. % silver and less than about 30 wt. % copper. Optimally, the interior portion contains at least about 90 wt. % copper and less than about 10 wt. % silver, while the exterior portion contains less than about 10 wt. % copper and at least about 50 wt. % silver. The alloy or mixture may be provided in the form of copper particles coated with silver. The silver coating may be provided, for example, by electrolytic deposition or by electroless deposition.

The reaction mixture is reacted at an elevated temperature in the range of about 750°–1500° C., preferably about 1000°–1400° C. and more preferably about 1300°–1400° C. In a particularly preferred embodiment, the reaction temperature is about 1350° C.

The gaseous atmosphere contains about 5–3000 ppm oxygen, preferably about 5–700 ppm and more preferably about 10–350 ppm. Lesser concentrations of oxygen result in a product having a larger metal phase than desired, and excessive oxygen results in a product having too much of the phase containing metal oxides (ferrite phase). The remainder of the gaseous atmosphere preferably comprises a gas such as argon that is inert to the metal at the reaction temperature.

In a preferred embodiment, about 1–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the metal oxides, copper and silver.

Inert anodes made by the process of our invention have ceramic phase portions and alloy phase portions or metal phase portions. The ceramic phase portions may contain both a ferrite such as nickel ferrite or zinc ferrite, and a metal oxide such as nickel oxide or zinc oxide. The alloy phase portions are interspersed among the ceramic phase portions. At least some of the alloy phase portions include an interior portion containing more copper than silver and an exterior portion containing more silver than copper.

Unless indicated otherwise, the following definitions apply herein:

a. Percentages for a composition refer to percent by weight.

b. In stating a numerical range or a minimum or a maximum for a temperature or for an element of a composition or for any other property herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 0.3 to 0.5 discloses 0.31, 0.32, 0.33 . . . and so on, up to 0.5, and a range of 750 to 1000 discloses 751, 752 . . . and so on, up to 1000, including every number or fraction or decimal therewithin, and "up to 0.5" discloses 0.01 . . . 0.1 . . . 0.2 and so on up to 0.5.)

DETAILED DESCRIPTION OF A PREFERRED EMBODIMENT

Figure 1:
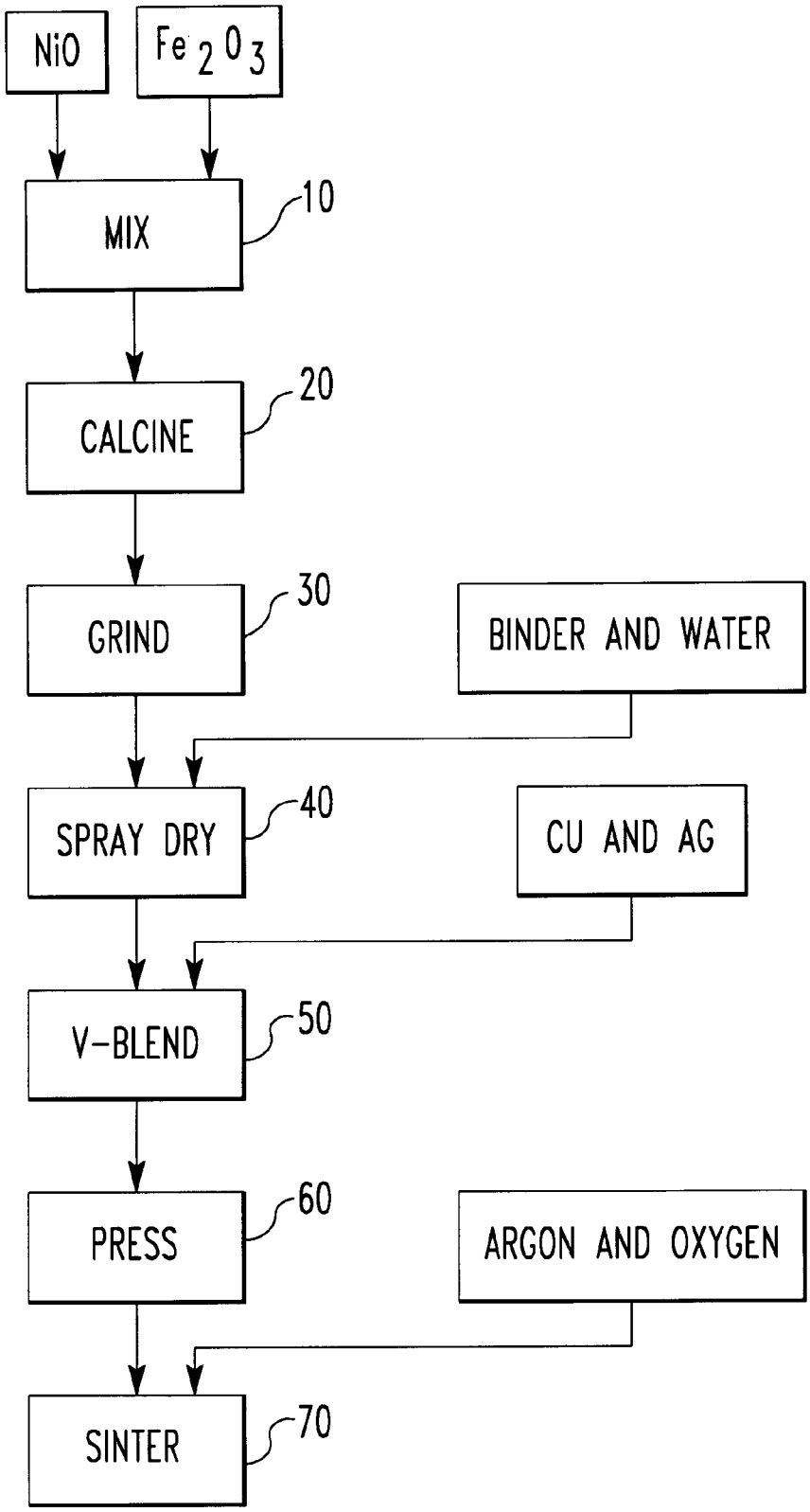
FIG. 1 is a flowsheet diagram of a process for making in inert electrode in accordance with the present invention.

In the embodiment diagrammed in FIG. 1, a process for making inert anodes starts by blending NiO and $Fe_2O_3$ powders in a mixer 10. Optionally, the blended powders may be ground to a smaller size before being transferred to a furnace 20 where they are calcined for 12 hours at 1250° C. The calcination produces a mixture having nickel ferrite spinel and NiO phases.

The mixture is sent to a ball mill 30 where it is ground to an average particle size of approximately 10 microns. The fine particles are blended with a polymeric binder and water to make a slurry in a spray dryer 40. The slurry contains about 60 wt. % solids and about 40 wt. % water. Spray drying the slurry produces dry agglomerates that are transferred to a V-blender 50 and there mixed with copper and silver powders.

The V-blended mixture is sent to a press 60 where it is isostatically pressed, for example at 20,000 psi, into anode shapes. The pressed shapes are sintered in a controlled atmosphere furnace 70 supplied with an argon-oxygen gas mixture. The furnace 70 is typically operated at 1350–1385° C. for 2–4 hours. The sintering process burns out polymeric binder from the anode shapes.

The starting material in one embodiment of our process is a mixture of copper powder and silver powder with a metal oxide powder containing about 51.7 wt. % NiO and about 48.3 wt. % $Fe_2O_3$. The copper powder nominally has a 10 micron particle size and possesses the properties shown in Table 1.

TABLE 1

Physical and Chemical Analysis of Cu Powder

| | Particle Size (microns) |
|---|---|
| 90% less than | 27.0 |
| 50% less than | 16.2 |
| 10% less than | 7.7 |

Spectrographic Analysis
Values accurate to a factor of ±3

| Element | Amount (wt. %) |
|---|---|
| Ag | 0 |
| Al | 0 |
| Ca | 0.02 |
| Cu | Major |
| Fe | 0.01 |
| Mg | 0.01 |
| Pb | 0.30 |
| Si | 0.01 |
| Sn | 0.30 |

Figure 2:
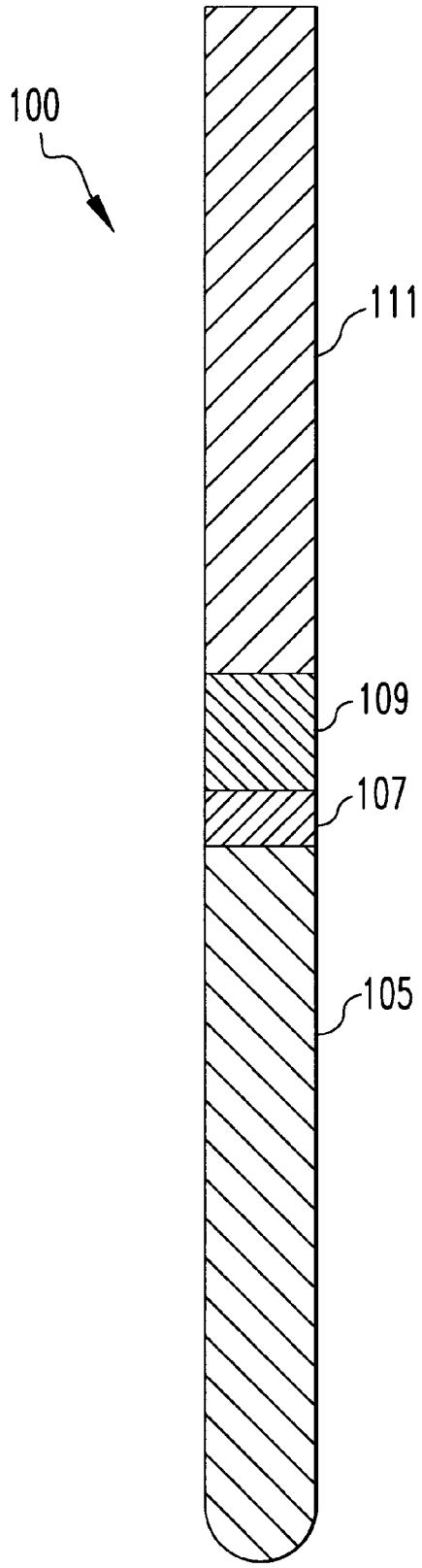
FIG. 2 is a schematic illustration of an inert anode made in accordance with the present invention.

About 83 parts by weight of the NiO and $Fe_2O_3$ powders are combined with 17 parts by weight of the copper and silver powder. As shown in FIG. 2, an inert anode 100 of the present invention includes a cermet end 105 joined successively to a transition region 107 and a nickel end 109. A nickel or nickel-chromium alloy rod 111 is welded to the nickel end 109. The cermet end 105 has a length of 96.25 mm, the transition region 107 is 7 mm long and the nickel end 109 is 12 mm long. The transition region 107 includes four layers of graded composition, ranging from 25 wt. % Ni adjacent the cermet end 105 and then 50, 75 and 100 wt. % Ni, balance the mixture of NiO, $Fe_2O_3$ and copper and silver powders described above.

The anode 10 is then pressed at 20,000 psi and sintered in an atmosphere containing argon and oxygen.

We made eight test anodes containing 17 to 27 wt. % of a mixture of copper and silver powders, balance an oxide powder mixture containing 51.7 wt. % NiO and 48.3 wt. % $Fe_2O_3$. The copper-silver mixture contained either 98 wt. % copper and 2 wt. % silver or 70 wt. % copper and 30 wt. % silver. The porosities and densities of these test anodes are shown below in Table 2.

TABLE 2

Test Anode Porosity and Density

| Anode Composition | Apparent Porosity (%) | Density ($g/cm^3$) |
|---|---|---|
| 17% (98 Cu-2 Ag) | 0.151 | 6.070 |
| 17% (70 Cu-30 Ag) | 0.261 | 6.094 |
| 22% (98 Cu-2 Ag) | 0.230 | 6.174 |
| 22% (70 Cu-30 Ag) | 0.321 | 6.157 |
| 25% (98 Cu-2 Ag) | 0.411 | 6.230 |
| 25% (70 Cu-30 Ag) | 0.494 | 6.170 |
| 27% (98 Cu-2 Ag) | 0.316 | 6.272 |
| 27% (70 Cu-30 Ag) | 0.328 | 6.247 |

These anodes were tested (without electrolysis) for 7 days at 960° C. in a molten salt bath having an $NaF/AlF_3$ ratio of 1.12, along with anodes containing 17 wt. % copper only and 83 wt. % of the NiO and $Fe_2O_3$ mixture. At the end of the test, a microscopic examination found that the silver-containing samples had significantly less corrosion and metal phase attack than samples containing copper only. We also observed that samples containing the 70 Cu-30 Ag alloy performed better than samples made with the 98 Cu-2 Ag alloy.

Microscopic examination of the samples made with 70 Cu-30 Ag alloy showed a multiplicity of alloy phase portions or metal phase portions interspersed among ceramic phase portions. Surprisingly, the alloy phase portions each had an interior portion rich in copper surrounded by an exterior portion rich in silver. In one sample made with 14 wt. % silver, 7 wt. % copper, 40.84 wt. % NiO and 38.16 wt. % $Fe_2O_3$, a microprobe x-ray analysis revealed the following metal contents in one alloy phase portion.

TABLE 3

Contents of Alloy Phase

| | Metal Content (wt. %) | | | |
|---|---|---|---|---|
| | Ag | Cu | Fe | Ni |
| Interior portion | 3.3 | 72 | 0.8 | 23 |
| Exterior portion | 90+ | 6 | 1.5 | 1.7 |

An anode made with 14 wt. % silver, 7 wt. % copper, 40.84 wt. % NiO and 38.16 wt. % $Fe_2O_3$ was cross-sectioned for x-ray analysis. An x-ray backscatter image taken at 493× showed several metal phase portions or alloy phase portions scattered in a ceramic matrix.

Sintering anode compositions in an atmosphere of controlled oxygen content lowers the porosity to acceptable levels and avoids bleed out of the metal phase. The atmosphere we used in tests with a mixture containing 83 wt. % NiO and $Fe_2O_3$ powders and 17 wt. % copper powder was predominantly argon, with controlled oxygen contents in the range of 17 to 350 ppm. The anodes were sintered in a Lindbergh tube furnace at 1350° C. for 2 hours. We found that anode compositions sintered under these conditions always had less than 0.5% porosity, and that density was approximately 6.05 $g/cm^3$ when the compositions were sintered in argon containing 70–150 ppm oxygen. In contrast, when the same anode compositions were sintered for the same time and at the same temperature in an argon atmosphere, porosities ranged from about 0.5 to 2.8% and the anodes showed various amounts of bleed out of the copper-rich metal phase.

Nickel and iron contents in the metal phase of our anode compositions can be controlled by adding an organic polymeric binder to the sintering mixture. Some suitable binders include polyvinyl alcohol (PVA), acrylic acid polymers, polyglycols such as polyethylene glycol (PEG), polyvinyl acetate, polyisobutylenes, polycarbonates, polystyrenes, polyacrylates and mixtures and copolymers thereof.

A series of tests was performed with a mixture comprising 83 wt. % of metal oxide powders and 17 wt. % copper powder. The metal oxide powders were 51.7 wt. % NiO and 48.3 wt. % $Fe_2O_3$. Various percentages of organic binders were added to the mixture, which was then sintered in a 90 ppm oxygen-argon atmosphere at 1350° C. for 2 hours. The results are shown in Table 4.

TABLE 4

Effect of Binder Content on Metal Phase Composition

| | Binder | Binder Content (wt. %) | Metal Phase Composition Fe (wt. %) | Ni (wt. %) | Cu (wt. %) |
|---|---|---|---|---|---|
| 1 | PVA | 1.0 | 2.16 | 7.52 | 90.32 |
| | Surfactant | 0.15 | | | |
| 2 | PVA | 0.8 | 1.29 | 9.2 | 89.5 |
| | Acrylic Polymers | 0.6 | | | |
| 3 | PVA | 1.0 | 1.05 | 10.97 | 87.99 |
| | Acrylic Polymers | 0.9 | | | |
| 4 | PVA | 1.1 | 1.12 | 11.97 | 86.91 |
| | Acrylic Polymers | 0.9 | | | |
| 5 | PVA | 2.0 | 1.51 | 13.09 | 85.40 |
| | Surfactant | 0.15 | | | |
| 6 | PVA | 3.5 | 3.31 | 32.56 | 64.13 |
| | PEG | 0.25 | | | |

The test results in Table 4 show that selection of the nature and amount of binder in the mixture can be used to control composition of the metal phase in the cermet. We prefer a binder containing PVA and either a surfactant or acrylic powder in order to raise the copper content of the metal phase. A high copper content is desirable in the metal phase because nickel anodically corrodes during electrolysis.

A preferred cell of our invention has a molten salt bath comprising aluminum fluoride, sodium fluoride, calcium fluoride and magnesium fluoride. The weight ratio of sodium fluoride to aluminum fluoride is preferably about 0.7 to 1.1. For example, a cell operated at 920° C. may have a bath ratio of 0.8 to 1.0 and preferably about 0.96. The preferred molten salt bath at 920° C. contains about 45.9 wt. % NaF, 47.85 wt. % $AlF_3$, 6.0 wt. % $CaF_2$ and 0.25 wt. % $MgF_2$.

Having thus described the invention, what is claimed is:

1. A process for producing aluminum by electrolytic reduction of alumina in a cell comprising a cathode, an inert anode containing copper and silver and at least two different metal oxides, and a molten salt bath containing metal fluorides and alumina, said process comprising:

(a) passing an electric current between said inert anode and said cathode through said molten salt bath, thereby to produce aluminum at said cathode and oxygen at said inert anode; and (b) maintaining said molten salt bath at a temperature in the range of about 900°–950° C.

2. The process of claim 1 comprising maintaining said molten salt bath at a temperature in the range of about 900°–940° C.

3. The process of claim 1 comprising maintaining said molten salt bath at a temperature in the range of about 900°–930° C.

4. The process of claim 1 comprising maintaining said molten salt bath at a temperature in the range of about 900°–920° C.

5. The process of claim 1 wherein said inert anode contains iron oxide and at least one other metal oxide selected from the group consisting of nickel, tin, zinc, yttrium and zirconium oxides.

6. The process of claim 1 wherein said inert anode contains iron oxide and nickel oxide.

7. The process of claim 1 wherein said molten salt bath contains sodium fluoride and aluminum fluoride in a weight ratio of about 0.7 to 1.1.

8. The process of claim 7 wherein said molten salt bath further contains calcium fluoride and magnesium fluoride.

9. The process of claim 1 wherein said molten salt bath contains sodium fluoride, aluminum fluoride, calcium fluoride, and magnesium fluoride.

10. An electrolytic cell for producing aluminum comprising:

(a) a cathode;

(b) an inert anode comprising at least one metal oxide and copper and silver; and (c) a molten salt bath comprising sodium fluoride, aluminum fluoride and alumina, said molten salt bath having a temperature in the range of about 900–950° C., (d) said cell producing aluminum at said cathode and oxygen at said inert anode by passing an electric current between said inert anode and said cathode.

11. The electrolytic cell of claim 10 wherein said cell comprises a plurality of generally vertical inert anodes interleaved with a plurality of generally vertical cathodes and said inert anodes have an active surface area about 0.5 to 1.3 times the surface area of said cathodes.

12. The electrolytic cell of claim 10 wherein said inert anode comprises at least two different metal oxides.

13. The electrolytic cell of claim 12 wherein said inert anode has a metal phase comprising about 2–30 wt. % silver and about 70–98 wt. % copper.

14. The electrolytic cell of claim 10 wherein said molten salt bath further comprises calcium fluoride and magnesium fluoride and the weight ratio of sodium fluoride to aluminum fluoride is about 0.7 to 1.1.

15. The electrolytic cell of claim 10 wherein said inert anode contains iron oxide and at least one other metal oxide selected from the group consisting of nickel, tin, zinc, yttrium and zirconium oxides.

16. In a process for producing aluminum by electrolytic reduction of alumina in a cell comprising a cathode, an inert anode comprising at least one metal oxide and copper and silver and a molten salt bath containing sodium fluoride and aluminum fluoride and alumina, said process comprising passing an electric current between said inert anode and said cathode, thereby to produce aluminum at said cathode;

the improvement comprising maintaining said molten salt bath at a temperature in the range of about 905–950° C., and including calcium fluoride and magnesium fluoride in said salt bath.

17. The process of claim 16 comprising maintaining said temperature in the range of about 905°–940° C.

18. The process of claim 16 comprising maintaining said temperature in the range of about 905°–930° C.

19. The process of claim 16 wherein said inert anode contains iron oxide and nickel oxide.

20. The process of claim 16 wherein the weight ratio of sodium fluoride to aluminum fluoride is about 0.7 to 1.1.

* * * * *